US008882221B2

(12) United States Patent
Bernard et al.

(10) Patent No.: US 8,882,221 B2
(45) Date of Patent: Nov. 11, 2014

(54) MODULAR MICRO-FLUID EJECTION HEAD ASSEMBLY

(75) Inventors: David Laurier Bernard, Lexington, KY (US); Paul William Dryer, Lexington, KY (US); David Golman King, Shelbyville, KY (US); Andrew Lee McNees, Lexington, KY (US); Timothy Lowell Strunk, Georgetown, KY (US)

(73) Assignee: Funai Electric Co., Ltd. (JP)

( * ) Notice: Subject to any disclaimer, the term of this patent is extended or adjusted under 35 U.S.C. 154(b) by 1680 days.

(21) Appl. No.: 12/195,451

(22) Filed: Aug. 21, 2008

(65) Prior Publication Data

US 2010/0045736 A1 Feb. 25, 2010

(51) Int. Cl.
*B41J 2/14* (2006.01)
*B41J 2/16* (2006.01)

(52) U.S. Cl.
CPC ..... *B41J 2/1623* (2013.01); *B41J 2/14072* (2013.01); *B41J 2/16* (2013.01)
USPC ..... 347/12; 347/50

(58) Field of Classification Search
None
See application file for complete search history.

(56) References Cited

U.S. PATENT DOCUMENTS

2007/0220723 A1 * 9/2007 Furuya et al. ..... 29/25.35

* cited by examiner

*Primary Examiner* — Jerry Rahll
(74) *Attorney, Agent, or Firm* — Amster, Rothstein & Ebenstein LLP

(57) ABSTRACT

A micro-fluid ejection head assembly and methods for fabricating micro-fluid ejection heads using separately fabricated electrical components. The micro-fluid ejection head has at least one base substrate, at least one fluid ejector actuator substrate attached to the base substrate; and at least a first logic component substrate hermetically sealed to the base substrate. The fluid ejector actuator substrate and the first logic component substrate are in electrical communication with each other.

4 Claims, 4 Drawing Sheets

MODULAR MICRO-FLUID EJECTION HEAD ASSEMBLY

TECHNICAL FIELD

The disclosure relates to micro-fluid ejection head structures and in particular to modular components for assembling micro-fluid ejection beads and to improved methods for making micro-fluid ejection heads.

BACKGROUND AND SUMMARY

Micro-fluid ejection devices such as ink jet printers continue to experience wide acceptance as economical replacements for laser printers. Micro-fluid ejection devices also are finding wide application in other fields such as in the medical, chemical, and mechanical fields. As the capabilities of micro-fluid ejection devices are increased to provide a wider variety of applications and capabilities, the ejection heads, which are the primary components of micro-fluid ejection devices, continue to evolve and become larger, more complex, and more costly to manufacture.

One significant obstacle to be overcome in micro-fluid ejection head manufacturing processes is that currently, ejection head chins are a carefully designed conglomeration of several functional blocks combined into a monolithic piece of silicon. Typical functional blocks may include a beater stack, addressing and firing logic blocks, chip memory, power FETs, and voltage regulators. Since all of the functional blocks are fabricated on the same piece of silicon there are design, process, and material constraints that must be in place for the entire chip so as not to damage or degrade any of the individual functional blocks. Such constraints may result in non-optimal versions of the constituent blocks. Accordingly, instead of having an optimal design for each functional block, the resulting overall design of the election head contains less than optimal components. Accordingly, there is a need for improved structures and methods for making micro-fluid ejection head that enable optimization of individual components without significantly increasing manufacturing costs for making the micro-fluid ejection heads.

With regard to the above, an exemplary embodiment of the disclosure provides a micro-fluid ejection head assembly and methods for fabricating micro-fluid ejection heads using separately fabricated electrical, electro-mechanical, and/or fluidic components. The micro-fluid ejection head has at least one base substrate, at least one fluid ejector actuator substrate attached to the base substrate; and at least a first logic component substrate hermetically sealed to the base substrate. The fluid ejector actuator substrate and the first logic component substrate are in electrical communication with each other.

One exemplary embodiment of the disclosure provides a micro-fluid ejection head assembly having separately fabricated electrical components. The micro-fluid ejection head has at least one base substrate, at least one fluid ejector actuator substrate attached to the base substrate; and at least a first logic component substrate hermetically sealed to the fluid ejector actuator substrate. The fluid ejector actuator substrate and the first logic component substrate are in electrical communication with each other.

Another exemplary embodiment of the disclosure provides a method of fabricating a micro-fluid ejection head having substantially optimized electrical components. The method includes separately fabricating a base substrate having electrical contacts and electrical tracing thereon, separately fabricating a first logic component substrate containing logic components for bonding to one of the ejection actuator substrate and the base substrate. The base substrate, actuator substrate, and first logic component substrate are bonded to one another so that there is electrical flow communication among the components and electrical connections between any two of the components are hermetically sealed therebetween.

An advantage of the embodiments of the disclosure is an ability to separately optimize micro-electronic components so that the capabilities of a micro-fluid ejection head may be increased. Other advantages may include hermetic bonding of electrical connections between components so that incidence of electrical component corrosion is minimized. Still other advantage may include an ability to combine components in multiple ways to obtain different products without significant retooling or design changes. The hermetic bonding techniques described herein also provide an ability to increase input/output connections between components to greater than 500, typically greater than 1000, so that logic component substrates can be separately manufactured from the fluid ejection actuator component substrates of a micro-fluid ejection head.

For the purposes of this disclosure, the term "functional block" is intended to be interchangeable with the term "logic block." In other words, a functional block may provide a logic function or some other function in the operation of the micro-fluid ejection head. Likewise, the term "logic block" is intended to include any type of functional block whether or not the functional block performs a specific logic function.

BRIEF DESCRIPTION OF THE DRAWINGS

Further advantages of the exemplary embodiments may become apparent by reference to the detailed description of the exemplary embodiments when considered in conjunction with the following drawings illustrating one or more non-limiting aspects of thereof, wherein like reference characters designate like or similar elements throughout the several drawings as follows.

DETAILED DESCRIPTION OF EXEMPLARY EMBODIMENTS

Figure 1:
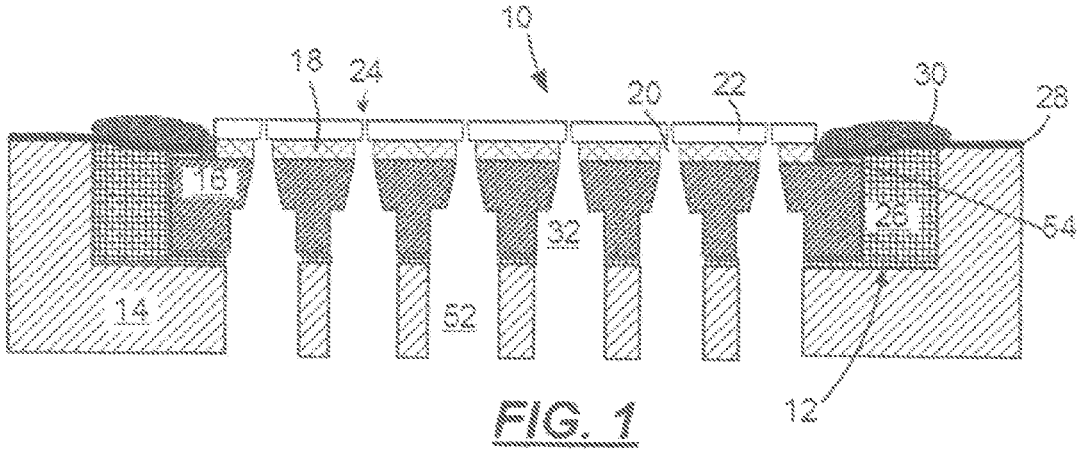
FIG. 1 is a cross-sectional view, not to scale, of a prior art micro-fluid ejection head assembly.

With reference to FIG. 1, there is illustrated a micro-fluid ejection head 10 attached in a ejection head pocket 12 to a fluid supply bottle 14. The ejection head 10 includes a substrate 16 containing electrical components and fluid ejection actuators thereon, a thick film layer 18 providing fluid ejection chambers 20 therein and a nozzle plate 22 having nozzles 24 therein for ejection of fluid from the ejection head 10. The ejection head 10 is attached using a die bond adhesive 26 to the bottle 14. Electrical connections are made to the substrate 16 by a flexible circuit or conductive tracing 28 that may be protected from contact with fluids ejected from the ejection head by an encapsulating material 30.

The substrate 16 may be a portion of a preformed silicon semiconductor wafer, or any functionally similar material, having at least one fluid flow slot 32 formed therein, as described below. In one embodiment, a plurality of micro-fluid ejection actuators 34 are associated with the slot 32 and are in electrical communication with a driver circuit that includes data arrays (PData) 36 and decode logic blocks 38 and 40. In another embodiment, each micro-fluid ejection actuator 34 may be associated with a corresponding aperture formed in the substrate 16. The substrate 16 may have a thickness ranging from about 10 to about 1000 microns. In one embodiment, the substrate 16 may have a thickness ranging from about 30 to about 800 microns. In the case of a relatively thin substrate 16, e.g. a substrate having a thickness of 200 microns or less, a relatively thick support material may be required to maintain the planarity of the substrate 16.

In the case where a support material is used for the relatively thin substrate 16, the support material may be a preformed portion of a glass or silicon wafer, or another material having a layer of silicon oxynitride, silicon carbide, silicon nitride, silicon oxide or glass deposited upon a surface thereon. The support material may have at least one fluid flow slot formed therein, corresponding to the slot 32 in the substrate 16. The support material may have a thickness ranging from about 1 mm to about 5 mm or more. For example, the support material may have a thickness ranging from about 100 microns to about 800 microns. Multiple thin layers of material may also be used to provide the support material. The multiple thin layers may include one or more materials that have been hermetically sealed to one another by a method described below, to provide a single support material.

The thick film layer 18 may be a substantially planar patterned layer of photoresist or any similar material wherein at least one fluid flow channel and the fluid ejection chambers 20 have been formed therein by the removal of at least a portion of the thick film layer 18 by conventional photo imaging and development processes. The thick film layer 18 may be adhesively bonded to the substrate 16, laminated to the substrate 16, or may be spin coated onto the substrate 16 and imaged and developed to provide the fluid flow channels and fluid ejection chambers 20.

The nozzle plate 22 may be a photoresist nozzle plate, a polyimide nozzle plate, a metal nozzle plate, or other substantially planar patternable or micro-machinable material suitable for the purpose of providing the nozzle 24 therein. In the case of a patternable thick film layer 18, the nozzle plate 22 may be laminated to, spun on, or adhesively attached to the thick film layer 18.

Figure 2:
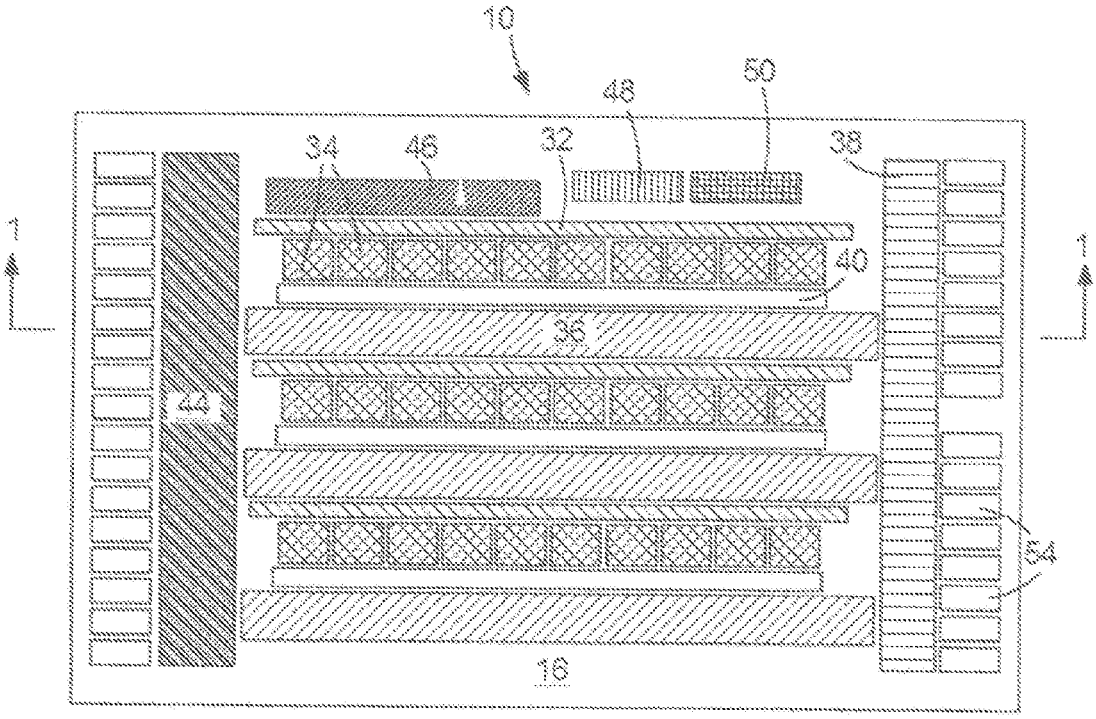
FIG. 2 is a plan view of an electrical component layout for a prior art micro-fluid ejection head assembly.

A plan view of the prior art ejection head 10 of FIG. 1 is illustrated in FIG. 2. The ejection head 10 illustrated in FIG. 2 is for ejecting multiple fluids therefrom. Accordingly, there are logic components and actuator arrays for each of fluids. Other prior art ejection heads may be designed to accommodate the ejection of one fluid, two fluids, four fluids, or more. However, the basic components are similar regardless of the number of fluids ejected from the ejection head 10.

As shown in FIG. 2, a first fluid is provided from a supply source through the supply slot 32 in the substrate 16 to arrays of fluid ejector actuators 34 adjacent to the supply slot 32. Individual actuators 34 within the arrays of actuators 34 are selected for activation by a combination of data arrays (PData) 36 and decode logic blocks 38 and 40 that are also disposed on the substrate 16. Volatile or non-volatile memory arrays 44, control logic components 46, and power sources 48 and 50 to activate the logic circuits and ejection actuators 34 may also be disposed on the substrate 16 as shown. In the prior art design illustrated in FIGS. 1 and 2, all the transistor/logic functions for the fluid ejector actuators 34 are fabricated using the same technology node, i.e. using the 1.2 μm gate dimension, and are made using the same process steps.

The substrate 16, thick film layer 18, and nozzle plate 22 are typically assembled as a single unit prior to bonding the substrate 16 to the support material, if used, or to the fluid supply bottle 14. However, the substrate 16 may also first be bonded to the support material or supply bottle 14 prior to attaching the thick film layer 18 and the nozzle plate 22 to the substrate 16. The thick film layer 18 and the nozzle plate 22 may also be integrated as a single component before being attached to the substrate 16.

After the substrate 16, including the nozzle plate 22 and the thick film layer 18, and the support material, if used, have been bonded to one another, the entire ejection head 10 may be inserted into and adhesively attached within the ejection head pocket 12 of the fluid supply bottle 14, as illustrated in FIG. 1. Alternatively, the support material may be adhesively attached within the pocket 12 of the bottle 14 prior to bonding an assembled ejection head 10 or an unassembled substrate 16 to the support material. The pocket 12 may have at least one slot 52 for fluid flow corresponding to the at least one slot 32 in the substrate 16.

The electrical tracing 28 of a flexible circuit may be attached to electrical connections 54 on the substrate 16 before the assembled fluid ejection head 10 is bonded or otherwise fixedly adhered to the bottle 14 using the die bond adhesive 26. The adhesive 26 may be of sufficient thickness to fill any gaps existing between the ejection head 10 and the bottle 14 in the pocket 12 as shown in FIG. 1, for example from about 0.1 microns to about 100 microns in thickness. As a further example, the adhesive layer may range from about 1 micron to about 50 microns in thickness. In order to reduce or eliminate corrosion of the electrical tracing 28 and connections 54, the protective encapsulant material 30 may be applied as a protective barrier over the electrical tracing 28 and connections 54.

As described in more detail below, when a support material is used for a relatively thin substrate 16, it is desirable that the support material be hermetically bonded to the substrate 16 and be comprised of a material that has a similar coefficient of thermal expansion (CTE) to that of the substrate 16. Both the thickness of the support material and the CTE similarity may lead to a reduction of warping of the ejection head 10 during the subsequent curing or annealing of any adhesive 26 and/or encapsulant 30 materials used to assemble the ejection head 10 and bottle 14 to one another.

However, in order to increase the functionality and performance of the micro-fluid ejection head and to provide for use of a wider variety of process techniques and materials, exemplary embodiments of the disclosure separate the various constituent block functions of the micro-fluid ejection head into individual, separately constructed components. The individual components may be separately manufactured and processed thus allowing the designers and fabricators more leeway and choices for optimizing the materials and designs of the components. For example, the logic blocks for the micro-fluid ejection head may be created using different technology nodes, processes, materials, and substrate types. The separately manufactured logic blocks may be fabricated as separate chips that are then integrated with a fluid ejector component to form an optimized modular micro-fluid ejection assembly. Integration of the logic blocks and fluid ejector components with one another may be achieved using a hermetic bonding technique that provides protection of critical electrical connections between the components of the assembly.

According to the hermetic bonding technique, substrates and chips containing a silicon oxide layer are covalent bonded to one another. The covalent bond that is formed between the oxide layers of the substrates and chips hermetically seals electrical connections between the substrates and chips without the need for adhesives, other intermediate layers, or encapsulating or underfill materials. In order to achieve hermetic bonding of the components to one another, a monolayer of an amine functional group is applied to each of relatively flat silicon oxide surfaces to be bonded together. The functional groups of the monolayer form a covalent bond between the two oxide surfaces essentially forming one continuous interface between the components. The resulting covalent bond has a strength that is essentially equal to the bond between silicon and oxide of the silicon oxide layer.

Figure 3:
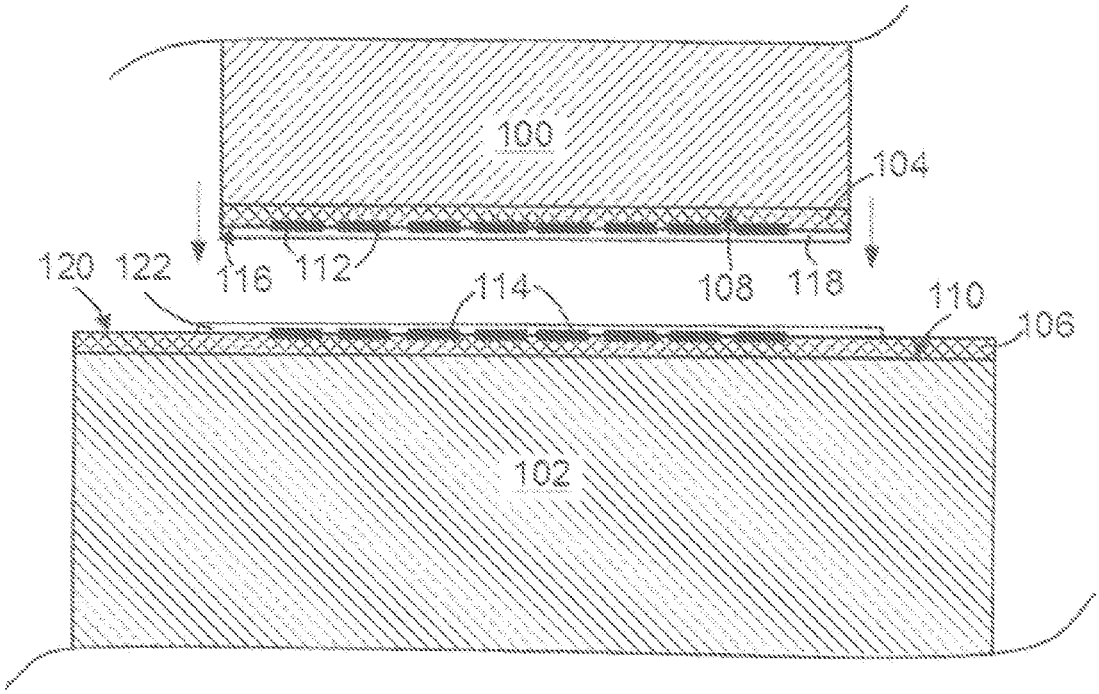
FIG. 3 is a cross-sectional view, not to scale, of a logic device and a substrate with electrical contacts containing a layer for effecting hermetic sealing between the logic device and substrate according to an embodiment of the disclosure.
Figure 4:
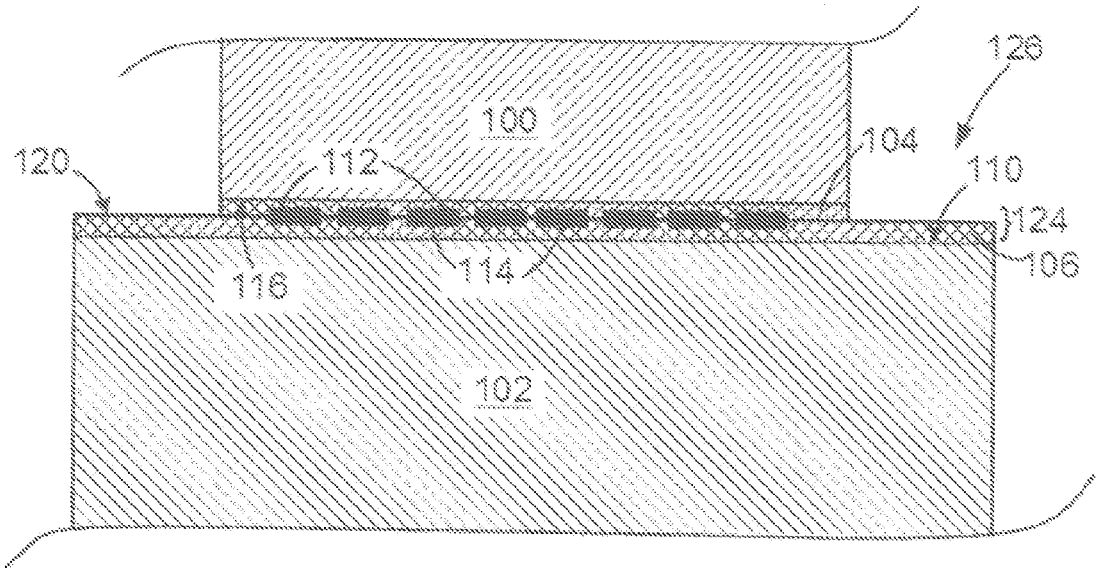
FIG. 4 is a cross-sectional view, not to scale, of a logic device and a substrate with electrical contacts sealed between the logic device and a substrate.

FIGS. 3 and 4 illustrate a process, according to the disclosure, for bonding a logic component 100 to a substrate 102 so that electrical connections are hermetically sealed therebetween. Each of the logic component 100 and substrate 102 may be made of silicon, for example a monocrystalline silicon wafer, so that silicon bonding layers 104 and 106 form on the surfaces 108 and 110 thereof. Accordingly, the logic component 100 or substrate 102 may be substantially composed of silicon, silicon oxide, silicon oxynitride, silicon carbide, silicon nitride, glass, or other silicon-containing material suitable for providing support to the device substrate.

In the case of a non-silicon substrate 102, a silicon-containing bonding layer 106 may be deposited on the surface 110 of the substrate 102. A suitable non-silicon substrate 102 may include alumina and other ceramic materials. In the case of silicon logic component 100 and substrate 102, the bonding layers 104 and 106 may be formed by oxidation of the surfaces 108 and 110 of the component 100 and substrate 102. In other alternative embodiments, the bonding layers 104 and 106 may be an insulator, such as silicon carbide, silicon oxynitride, silicon nitride, spun-on-glass ("SOG"), or amorphous silicon, formed using chemical vapor deposition ("CVD") or plasma-enhanced CVD ("PECVD"), sputtering, or evaporation. Other silicon-containing materials such as polymers, semiconductors or sintered materials may also be used.

In one embodiment, hexamethyldisiloxane ("HMDS") may be applied to a non-silicon surface, such as an alumina surface 110, of the substrate 102 to form the silicon bonding layer 106 on the alumina surface 110. Such a non-silicon surface 110 having the silicon bonding layer 106 formed thereon may be suitable for bonding with a silicon logic component 100 using the presently disclosed methods. Each of the logic component 100 and substrate 102 also contain a plurality of electrical contacts 112 and 114 for electrical connection between the logic component 100 and substrate 102.

The process of bonding the logic component 100 and substrate 102 to one another includes wetting at least a first surface 116 of the bonding layer 104 of the logic component 100 with a small amount of basic solution, so that a layer 118 of basic solution is formed on the surface 116. The thickness of the layer 118 of basic solution may range from about 0.1 to about 10 microns, and may suitably range from about 1 to about 5 microns. In an alternative process, a surface 120 of the bonding layer 106 of the substrate 102 may also be wetted with the basic solution, so that a layer 122 of basic solution is formed on the surface 120.

In an exemplary embodiment of the present disclosure, the bonding process may include contacting one or more of the surfaces 116 and 120 with a solution containing a base, wherein the base is selected from tetramethylammonium hydroxide (TMAH), KOH, NaOH, $NH_4OH$, LiOH, hydrazine, ethylene-diamine-pyrocatecol (EDP), ethelene-piperidine-pyrocatechol (EPP), and the like. The solution may be aqueous. The concentration of the aqueous solution may range from about 0.5 to about 5 weight %, and as a further example from about 1 to about 3 weight %. In one embodiment the solution may be from about 1 to about 3% by weight of TMAH based on the total weight of the solution. Contacting the surfaces 116 and 120 with the solution may be accomplished by spraying, roll coating, dipping, vapor deposition, or immersion of the surfaces 116 and 120 in the solution.

In another exemplary embodiment of the present disclosure, one or more of the surfaces 116 and 120 may be wetted with the basic solution, and the two surfaces 116 and 120 may subsequently be contacted together at a temperature ranging from about 20° C. to about 90° C., for a period of time ranging from about 1 minute to about 15 minutes. The contacted surfaces 116 and 120 may be pressed together using pressure ranging from about 1 psi to about 50 psi. As a further example, a force ranging from about 5 psi to about 15 psi may be used to press the two surfaces 116 and 120 together. In one suitable embodiment, the force may be about 10 psi. Covalent bonds may spontaneously form between the two surfaces 116 and 120 at points of contact between the two surfaces 116 and 120, forming a substantially hermetic seal 124 between the two surfaces 116 and 120.

The two surfaces 116 and 120 may be hermetically sealed together by covalent bonds to provide a substantially unitary structure 126 as shown in FIG. 4. Additional force, pressure, or temperature may or may not be required to be applied to the logic component 100 and the substrate 102 during the contacting of the two surfaces 116 and 120 in order to allow them to achieve favorable proximity for bond formation.

TMAH, KOH, NaOH, LiOH, CsOH, $NH_4OH$, hydrazine, EDP, and EPP are known in the art as silicon etchants. It is believed that the basic solution may dissolve some of the surface 116 or 120 of the silicon bonding layer 104 or 106, thereby forming a bonding material believed to be a silicate glass that adheres the component 100 to the substrate 102. When the basic solution wetted surface is contacted with a silicon, silicon oxide, silicon oxynitride, silicon carbide, or silicon nitride surface the silicate glass forms a hermetic bond at the junction of the two surfaces, such that the layer of silicate glass 124 may be interposed between the two surfaces.

The application of basic solution to the surfaces 116 and 120 may help to ameliorate any surface roughness of the surfaces to which the basic solution is applied by filling in some of the gaps and dissolving some of the high spots on one or more of the bonding surfaces 116 and 120. Hence, the surfaces 116 and 120 need not be specially treated or planarized prior to the bonding process. In the alternative, the surfaces 116 and/or 120 or surfaces 108 and/or 110 may optionally be back-ground prior to the bonding process. A suitable surface roughness for the surface 116 may range from about 25 Angstroms to about one micron while surface 120 may be substantially planar or may have a surface roughness similar to the surface roughness of surface 116.

Without desiring to be bound by theory, it is believed that the following reactions occur when the silicon is contacted by a basic solution as described by Madou in *Fundamentals of Microfabrication*. First, as seen in Equation 1, elemental silicon is attacked by hydroxide ions to for $Si(OH)_2^{2-}$.

$$Si+2OH^- \rightarrow Si(OH)_2^{2-}+2e^- \quad (1)$$

A second reaction then occurs as the $Si(OH)_2^{2-}$ is then further attacked by hydroxide ions, lending to $Si(OH)_4$, as shown in Equation 2.

$$Si(OH)_2^{2-}+2OH^- \rightarrow Si(OH)_4+2e^- \quad (2)$$

The third reaction is the conversion of $Si(OH)_4$ with water to produce soluble $Si(OH)_6$ and hydrogen gas.

$$Si(OH)_4+4e^-+4H_2O \rightarrow Si(OH)_6^{2-}+2H_2 \quad (3)$$

The present process may be conducted under a hydrogen gas atmosphere, thus forcing the reaction back towards the $Si(OH)_4$ product, which is unstable and spontaneously converts to silicate glass. It is this silicate glass formation that is believed to provide the strong bonding between the two surfaces 116 and 120.

Gasses suitable for providing a hydrogen gas atmosphere may include pure hydrogen gas, or one or more hydrogen-containing "forming gasses". A forming gas is a non-combustible mixture of an inert gas and a reactive gas. In embodiments of the present disclosure, suitable forming gasses may include nitrogen/hydrogen mixtures, argon/hydrogen mixtures, helium/hydrogen mixtures, and the like. The forming gas may comprise a major amount of the inert gas and a minor amount of the reactive gas. For the purposes of this disclosure, a major amount is defined as greater than 50% by volume, and a minor amount is defined as less than 50% by volume, of the total forming gas volume. One suitable example of a forming gas may be a mixture of 95% by volume of $N_2$ and 5% by volume of $H_2$. As another suitable example, the forming gas may be a mixture of 95% by volume of He and 5% by volume of $H_2$. Still another suitable forming gas may be a mixture of 30% $H_2$ and 70% Ar by volume.

In a further embodiment of the present disclosure, a material suitable for bonding two silicon oxide surfaces may be prepared by dissolving a small amount of silicon in an aqueous solution of TMAH, while maintaining the solution in a hydrogen rich atmosphere. In one embodiment, sufficient silicon may be dissolved in the TMAH to form a slurry. The amount of silicon dissolved in the TMAH solution may range from about 0.1 to about 10 percent by weight based on the total weight of the solution. The TMAH/silicon slurry may then be applied to one or more of the surfaces. The surfaces may subsequently be contacted together under an atmosphere containing hydrogen gas for a duration ranging from about 1 minute to about 15 minutes, at a temperature ranging time about 20° C., to about 90° C., using a pressure ranging from about 1 psi to about 50 psi, while maintaining the surfaces in the hydrogen atmosphere.

Prior to bonding the logic component 100 as the substrate 102 to one another, the logic component 100 and substrate 102 are aligned to one another. Alignment fiducials may optionally be present on the logic component 100 and substrate 102 for the purpose of ensuring proper alignment of the component 100 to the substrate 102 support. In another embodiment of the disclosure, infrared cameras may be used by an automated system in order to ensure proper alignment of the component 100 to the substrate 102. Such methods of aligning components to substrates are well known to those skilled in the art.

Advantages of the foregoing bonding technique as compared to adhesive bonding techniques may include, but are not limited to:

a) Hermetic seal: The bonding technique described herein hermetically seals the component 100 to the substrate 102. The bond is essentially a continuation of a silicon oxide lattice so fluid will not leak or be absorbed between the component 100 and substrate 102.

b) Room temperature cure: While adhesive bonds are typically cured at a high temperature causing expansion and contraction during cooling, essentially low temperature bonding is effected with the method described herein. High temperature curing is a major contributor to poor chip planarity and fluid ejection misdirection.

c) Stress-free bonding: Bonding a component 100 to a ceramic substrate 102 (with a silicon oxide layer) is stress-free because component 100 and substrate 102 are bonded at room temperature and the materials being bonded are similar to one another.

d) No coefficient of thermal expansion (CTE) mismatch: Since the component 100 and substrate 102 are similar materials, there is virtually no CTE mismatch between the materials.

e) High density of electrical connections: Use of the hermetic bonding technique enables up to 1.5 million connections per square centimeter to be made between the component 100 and the substrate 102. For example, input/output contacts of greater than 500 per chip may be obtained using the process of the disclosure.

Figure 5:
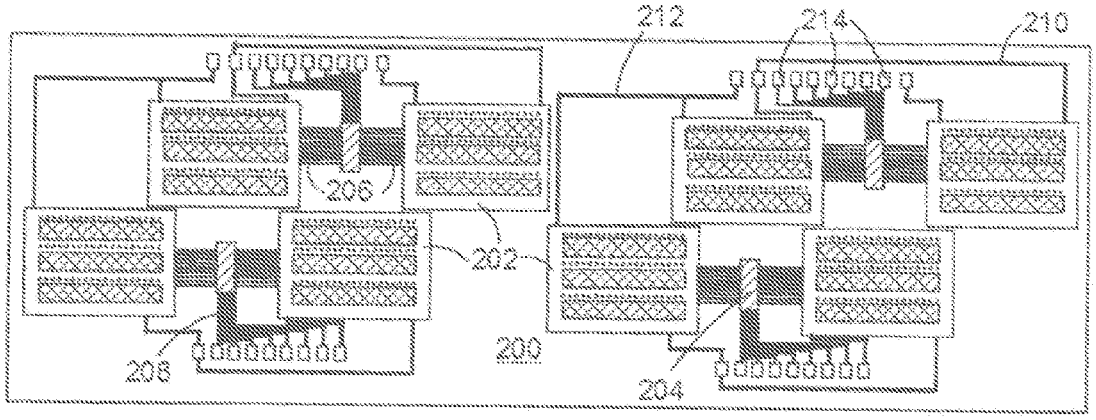
FIG. 5 is a plan view, not to scale, of a support substrate containing a plurality of micro-fluid ejection heads and logic components according to another embodiment of the disclosure.
Figure 6:
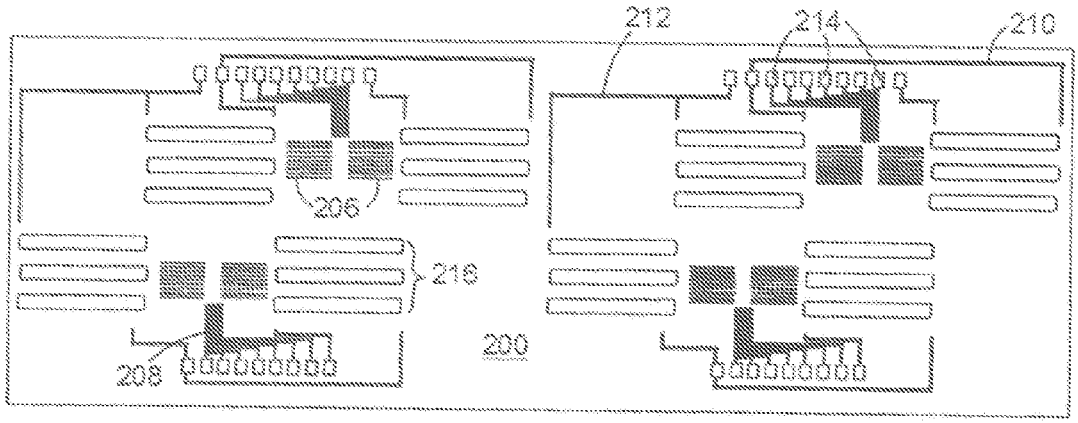
FIG. 6 is a plan view, not to scale, of the support substrate of FIG. 5 showing electrical tracing thereon and fluid therethrough with the logic devices and ejection heads removed.

In one embodiment, illustrated in FIGS. 5 and 6, a base substrate 200, made of silicon or other materials described above, may contain a plurality of ejection head chips 202 and separately attached decode/driver chips 204 for the ejection head chips 202. The ejection head chips 202, base substrate 200, and/or decode/driver chips 204 may be produced separately at the same or different fabrication facilities. Each of the ejection head chips 202 may include the decode functions necessary to drive all the ejection actuators on the chips 202, but may require a decode/driver chip 204 with access to an external control unit such as a printer to address the ejection head chips 202. Accordingly, each ejection head chip 202 may be devoid of a floating gate memory, an analog to digital module, and/or a voltage regulator. The chips 202 may be devoid of other functional blocks that may be included on the substrate 200, in the decode/driver chips 204, or in other chins attached to the substrate 200.

Since the decode/drive functions are not included on the ejection head chips 202, the decode/driver chips 204 now be separately fabricated or may be provided by an off the shelf component. The decode/driver chips 204 may be in electrical communication with one or more of the ejection head chips 202 through a common communication bus 206 with the ejection head chips 202 each having a unique address on the communication bus 206. Electrical communication between the substrate 200 and an external control unit may be achieved using USB, LVDS, SERDES LVDS, or some other high speed digital interface.

Logic blocks that are separately fabricated from the ejection head chips 202 may be included in individual chips. Accordingly, the logic blocks may be fabricated using higher end technology nodes, different process conditions, different materials, and/or different substrate types than the ejection head chips 202. Separate fabrication of the logic blocks may allow increased speed, increased and expanded functionality, and the like as compared to logic and/or functional blocks that are fabricated on the monolithic substrate 16 illustrated in FIGS. 1 and 2.

As shown in FIGS. 5 and 6, the fluid ejection head chips 202 and decode/driver chips 204 and any other separate logic and/or functional blocks may be attached to base substrate 200. The base substrate 200 may include signal traces 208, ground traces 210, ejection head chip drive voltage traces 212, and contact pans 214 for connection to the external control unit. The base substrate 200 to which the ejection head chips 202 and decode/driver chips 204 are attached may include one or more fluid supply slots 216 for supplying fluid to the ejection actuators on the ejection head chips 202. FIG. 6 illustrates the base substrate 200 with the chips 202 and 204 removed. The fluid supply slots 16 that supply fluid to each of the chips 202 are shown under the area occupied by the chips 202 in FIG. 5.

The chips 202 and 204 may be attached face-to-face to the substrate 200 allowing direct connection from the chips 202 and 204 to contact pads on the base substrate 200 as described and illustrated in FIGS. 3 and 4, or by using through silicon vias to allow electrical connection from the base substrate 200 to the contact pads on the chips 202 and/or 204.

In the embodiment illustrated in FIGS. 5 and 6, the ejection head chips 202 and decode/driver chips 204 were separated from one another. As shown, each decode/driver chip 204 addresses two ejection head chips 202. However, it sarcoid be appreciated that a decode/driver chip 204 may address one to several ejection head chips 202 depending on need and available input/output (I/O) for that chip 202. Furthermore, additional logic blocks may be attached to the base substrate 200 with the corresponding contact pads 214 and traces 206, 208, 210, and 212 needed to provide the required I/O to the logic and/or functional blocks.

Figure 7:
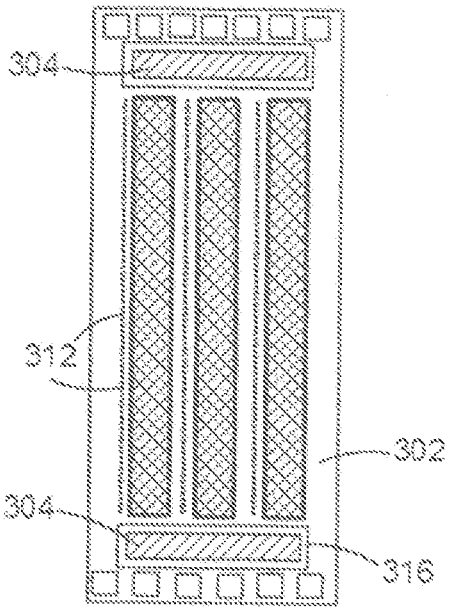
FIG. 7 is a plan view, not to scale, of a micro-fluid ejection head assembly according to another embodiment of the disclosure.
Figure 8:
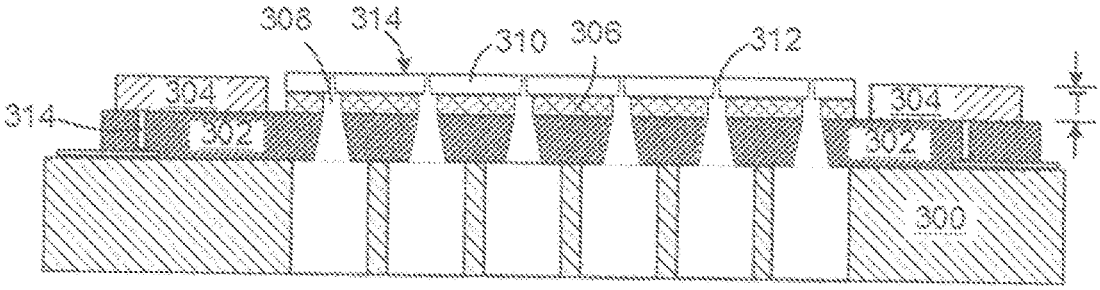
FIG. 8 is a cross-sectional view, not to scale, of a portion of a micro-fluid ejection head assembly according to an embodiment of the disclosure.
Figure 9:
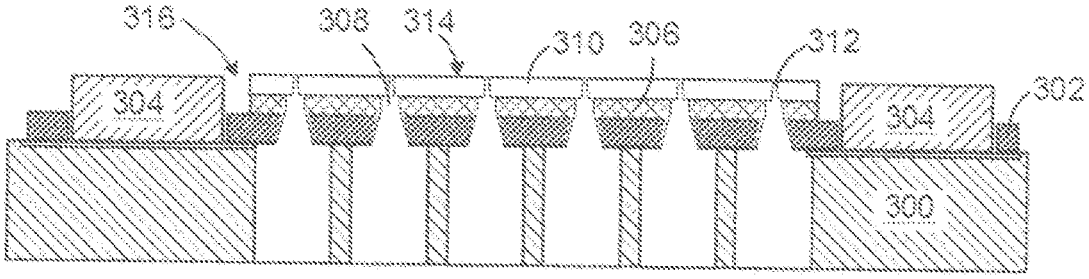
FIG. 9 is a cross-sectional view, not to scale, of a portion of a micro-fluid ejection head assembly according to another embodiment of the disclosure

Another alternative embodiment of the disclosure is illustrated in FIGS. 7-9. As in the previous embodiment, a base substrate 300, ejection head chips 302, and decode/driver chips 304 may be fabricated in the same or different fabrication facilities. The decode/driver chips 304 may also be provided by off the shelf components. However, in the embodiment illustrated in FIG. 8, the decode/driver chips 304 are bonded directly to the ejection head chips 302 using the hermetic bonding techniques described above. As shown in FIG. 8, the ejection head chips 302 have bonded thereto, a thick film layer 306 containing fluid ejection chambers 308 and a nozzle plate 310 containing a plurality of nozzles 312. The decode/driver chips 304 may be thinned to an overall thickness T of the thick film layer 306 and nozzle plate 310, which may be, for example, about 30 μm so that when bonded the decode/driver chips 304 will not stick up above a surface 314 of the nozzle plate 310.

As shown in FIG. 3, the decode/driver chips 304 may be attached to the ejection head chips 302 using the hermetic bonding process described above, or other suitable processes such as by the use of adhesives. In the hermetic bonding process, the chips 302 and 304 are bonded face to face with electrical connection therebetween to provide electrical communication from chip 304 to chip 302 as illustrated in FIGS. 3 and 4. Silicon vias 314 may be provided through the ejection head chips 302 to provide electrical connection of the chips 304 to the base substrate 300.

In an alternative embodiment, shown in FIG. 9, the decode/driver chips 304 may be electrically connected directly to the base substrate 300 by providing a pocket 316 in the ejection head chip 302. Accordingly, the chip 302 and base substrate 300 and the chips 304 and base substrate 300 may be bonded face-to-face using the bonding technique described above wherein the electrical contacts are hermetically sealed between the bonded components. The pocket 316 for the chips 304 may be filled with an encapsulating material to further protect the electrical connections from corrosive fluids.

An advantage of the foregoing embodiments is that the embodiments may be applicable to single fluid ejection heads, to page wide ejection head arrays, and to even larger ejection head configurations. Another advantage is that the chips 204 and 304 may be designed with functionality that enables use on a wide variety of different ejection head applications. Hence, the chips 204 and 304 may be designed once and interconnected in different configurations to provide different functions. Since the chips 204 and 304 are fabricated separately from the ejection head chips 202 or 302, different materials and fabrication techniques may be used for each component enabling optimization of the design and fabrication of the components. Yields of ejection head products may be increased because separate testing of the ejection head chips 204 and 304 and the ejection head chips 202 and 302 may be conducted before the components are assembled to one another. Furthermore, alternative means for attaching chips 302 and 304 and base substrates 300 to one another may include the selective use of adhesives rather than the hermetic bonding technique described herein. The use of adhesives also enables separate fabrication and assembly of the components thereby also enabling yields of ejection head products to be increased and the ability to separately optimize microelectronic components so that the capabilities of micro-fluid ejection heads may be increased The foregoing embodiments are susceptible to considerable variation in their practice. Accordingly, the embodiments are not intended to be limited to the specific exemplifications set forth hereinabove. Rather, the foregoing embodiments are within the spirit and scope of foe appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A micro-fluid ejection head assembly comprising:

at least one base substrate for a micro-fluid ejection head;

at least one fluid ejector actuator substrate attached to the base substrate; and at least a first logic component substrate hermetically sealed to the base substrate, wherein the fluid ejector actuator substrate and the first logic component substrate are in electrical communication with each other, wherein the base substrate comprises two or more fluid ejector actuator substrates attached thereto and a second logic component in electrical communication with two or more fluid ejector actuator substrates.

2. The micro-fluid ejection head assembly of claim 1, wherein the base substrate has a thickness ranging from about 100 μm to about 800 μm.

3. The micro-fluid ejection head assembly of claim 1, wherein the fluid actuator substrate has a thickness ranging from about 800 μm to about 30 μm.

4. The micro-fluid ejection head assembly of claim 1, wherein the logic component substrate has a thickness ranging from about 800 μm to about 30 μm.

* * * * *